US005197676A

United States Patent [19]

Konieczynski et al.

[11] Patent Number: 5,197,676

[45] Date of Patent: Mar. 30, 1993

[54] APPARATUS FOR DISPENSING CONDUCTIVE COATING MATERIALS

[75] Inventors: Ronald D. Konieczynski, North Royalton; Bruce C. Hills, Amherst; Kenneth J. Coeling, Westlake, all of Ohio

[73] Assignee: Nordson Corporation, Westlake, Ohio

[21] Appl. No.: 766,796

[22] Filed: Sep. 27, 1991

Related U.S. Application Data

[63] Continuation-in-part of Ser. No. 618,089, Nov. 26, 1990, which is a continuation-in-part of Ser. No. 554,795, Jul. 18, 1990, Pat. No. 5,078,168.

[51] Int. Cl.[5] ..... B05B 5/02

[52] U.S. Cl. ..... 239/690; 239/691

[58] Field of Search ..... 239/690, 691, 3, 708; 118/621

[56] References Cited

U.S. PATENT DOCUMENTS

| | | | |
|---|---|---|---|
| 3,240,225 | 3/1966 | Barrows . | |
| 3,315,899 | 4/1967 | Quarve . | |
| 3,747,850 | 7/1973 | Hastings et al. . | |
| 3,895,748 | 7/1975 | Klingenberg . | |
| 3,906,122 | 9/1975 | Krause et al. . | |
| 3,929,286 | 12/1975 | Hastings et al. . | |
| 3,937,400 | 2/1976 | Krause . | |
| 3,971,337 | 7/1976 | Hastings . | |
| 3,999,691 | 12/1976 | Doom . | |
| 4,004,717 | 1/1977 | Wanke . | |
| 4,017,029 | 4/1977 | Walberg . | |
| 4,020,866 | 5/1977 | Wiggins . | |
| 4,053,012 | 10/1977 | Farmer . | |
| 4,085,892 | 4/1978 | Dalton . | |
| 4,124,163 | 11/1978 | Siegmann . | |
| 4,142,707 | 3/1979 | Bjorklund . | |
| 4,275,834 | 6/1981 | Spanjersberg et al. . | |
| 4,313,475 | 2/1982 | Wiggins . | |
| 4,489,893 | 12/1984 | Smead . | |
| 4,544,570 | 10/1985 | Plunkett et al. . | |
| 4,629,119 | 12/1986 | Plunkett et al. . | |
| 4,657,047 | 4/1987 | Kolibas . | |
| 4,660,598 | 4/1987 | Butterfield et al. . | |
| 4,771,729 | 9/1988 | Planert et al. . | |
| 4,792,092 | 12/1988 | Elberson et al. | 239/691 X |
| 4,879,137 | 11/1989 | Behr et al. . | |
| 4,921,169 | 5/1990 | Tilly . | |
| 4,932,589 | 6/1990 | Diana . | |
| 5,078,168 | 1/1992 | Konieczynski | 239/691 X |
| 5,094,389 | 3/1992 | Giroux et al. | 239/691 X |

FOREIGN PATENT DOCUMENTS

| | | |
|---|---|---|
| 3725172 | 3/1987 | Fed. Rep. of Germany . |
| 8705832 | 10/1987 | PCT Int'l Appl. . |

*Primary Examiner*—Andres Kashnikow
*Assistant Examiner*—Kevin P. Weldon
*Attorney, Agent, or Firm*—Ruden, Barnett, McClosky, Smith, Schuster & Russell

[57] ABSTRACT

An apparatus is provided for transferring electrically conductive coating materials, such as water-based paint, from at least one source to one or more coating dispensers for discharge onto a substrate. One voltage block is provided to avoid the creation of an electrical path between one or more sources of coating material and the coating material which is electrostatically charged during a coating operation, and a secondary voltage block is provided between each of a number of individual spray guns and the charged coating material so that each spray gun can be electrically isolated from the charged coating material when not is use. The apparatus is optionally provided with a color changer, and/or a heater which is electrically isolated from the charged coating material and is effective to elevate the temperature of the coating material prior to discharge from the spray guns.

20 Claims, 7 Drawing Sheets

FIG. IA

APPARATUS FOR DISPENSING CONDUCTIVE COATING MATERIALS

This application is a continuation-in-part of U.S. patent application Ser. No. 07/618,089, to Konieczynski et al, filed Nov. 26, 1990, and entitled "Apparatus For Electrostatically Isolating and Pumping Conductive Coating Materials", which is a continuation-in-part of U.S. patent application Ser. No. 07/554,795, filed Jul. 18, 1990, now U.S. Pat. No. 5,078,168 to Konieczynski, and entitled "Apparatus For Electrostatically Isolating Conducting Coating Materials", both of which are owned by the assignee of this invention.

FIELD OF THE INVENTION

This invention relates to electrostatic spray coating, and, more particularly, to a method and apparatus for dispensing electrically conductive coating materials from one or more dispensers wherein the source of supply of the conductive coating material is electrostatically isolated from the high voltage electrostatic power supply and each of the coating dispensers is electrically isolated from such power supply when not in use.

BACKGROUND OF THE INVENTION

The application of coating materials using electrostatic spraying techniques has been practiced in industry for many years. In these applications, the coating material is discharged in atomized form and an electrostatic charge is imparted to the atomized particles which are then directed toward a substrate maintained at a different potential to establish an electrostatic attraction for the charged atomized particles. In the past, coating materials of the solvent-based variety, such as varnishes, lacquers, enamels and the like, were the primary materials employed in electrostatic coating applications. The problem with such coating materials is that they create an atmosphere which is both explosive and toxic. The explosive nature of the environment presents a safety hazard should a spark inadvertently be generated, such as by accidentally grounding the nozzle of the spray gun, which can ignite the solvent in the atmosphere causing an explosion. The toxic nature of the workplace atmosphere created by solvent coating materials can be a health hazard should an employee inhale solvent vapors.

As a result of the problems with solvent-based coatings, the recent trend has been to switch to water-based coatings which reduce the problems of explosiveness and toxicity. Unfortunately, this switch from electrostatically spraying solvent-based coatings to those of the water-based type has sharply increased the risk of electrical shock, which risk was relatively minor with solvent-based coatings. The risk of electrical shock is occasioned in the use of water-based coatings due to their extreme electrical conductivity, with resistivities of such water-based coatings often falling within the range of 100 to 10,000 ohm centimeters This is in contrast to resistivities of 200,000 to 100,000,00 ohm centimeters for moderately electrically conductive coatings such as metallic paint, and resistivities exceeding 100,000,000 ohm centimeters for solvent-based lacquers, varnishes, enamels and the like.

The relative resistivity of the coating material is critical to the potential electrical shock which may arise during an electrostatic coating operation. With coating materials which are either not electrically conductive or only moderately electrically conductive, the column of coating material which extends from the charging electrode at the tip of the coating dispenser through the hoses leading back to the supply tank has sufficient electrical resistance to prevent any significant electrostatic charging of the material in the supply tank or the tank itself. However, when coating material is highly electrically conductive, as are water-based coatings, the resistance of the coating column in the supply hose is very low. As a result, a high voltage charging electrode located in the vicinity of the nozzle of the coating dispenser electrostatically charges not only the coating particles, but the coating material in the hose, the coating material in the supply tank and the supply tank itself Under these circumstances, operating personnel inadvertently coming into contact with an exposed supply tank, or a charged hose, or any other charged part of the system, risk serious electrical shock unless such equipment is grounded to draw off the electricity. If the equipment is indeed grounded at any point, however, the electrostatics will not function because the high voltage charge would be conducted away from the coating dispenser electrode as well.

One of the methods for reducing the electrical shock problem is disclosed, for example, in U.S. Pat. No. 3,971,337 to Hastings, which is owned by the same assignee as this invention. The Hastings patent discloses an apparatus for electrostatically isolating the supply tank which is connected to the coating dispenser. While this device is satisfactory for batch operations, it does not readily lend itself to continuous painting lines, i.e., applications wherein an essentially continuous supply of coating material must be provided over a period of time This problem has been addressed in apparatus of the type disclosed, for example, in U.S. Pat. No. 4,313,475 to Wiggins. In apparatus of this type, a "voltage block" system is employed wherein an electrically conductive coating material is first transmitted from a primary coating supply into a transfer vessel which is electrically isolated from one or more electrostatic coating dispensers. When filled with coating material, the transfer vessel is first disconnected from the primary coating supply and then connected to an inventory tank, which, in turn, is connected to the coating dispensers. The coating material is transmitted from the transfer vessel into the inventory tank, with the transfer vessel disconnected from the primary coating supply, to fill the inventory tank with coating material for subsequent transfer to the coating dispensers. After the inventory tank is filled, the transfer vessel is disconnected from the inventory tank and connected back to the primary coating supply to receive another quantity of coating material so that the coating operation can proceed essentially continuously.

The coating material supplied from the inventory tank in the U.S. Pat. No. 4,313,475 system is subjected to a high voltage electrostatic charge, upstream from the coating dispensers, so that charged coating material is supplied to each of a number of coating dispensers for deposition onto a substrate. In the event different colors are to be dispensed from such system, a color changer is provided which fills the inventory tank with a desired color for subsequent transmittal to the transfer vessel supplying the coating dispensers.

Current National Fire Protection Code provisions for electrostatic spray painting require the electrostatics to each manually operated coating dispenser to be shut down when the trigger of the gun is released. One problem with systems of the type disclosed in the Wiggins U.S. Pat. No. 4,313,475 is that no provision is made to electrically isolate each of the coating dispensers when not in use, i.e., when the operator releases the trigger of the dispenser. As mentioned above, a high voltage electrostatic charge is applied to the coating material discharged from the transfer vessel of the U.S. Pat. No. 4,313,475 system upstream from the coating dispensers so that the coating material and, hence, the coating dispensers, all remain charged regardless of whether or not the dispensers are in use. While this system may be satisfactory for automatically operated coating dispensers, the National Fire Protection Code requirements for manually operated spray guns are not met by the U.S. Pat. No. 4,313,475 system.

Another problem with systems of the type disclosed in the Wiggins U.S. Pat. No. 4,313,475 is that the color changer associated with such system is located upstream from the inventory tank. In order to change colors, essentially the entire system must be cleaned, i.e., the inventory tank, transfer vessel, coating dispensers, and all the lines interconnecting these elements. This is a time-consuming and cumbersome operation which is unacceptable in applications wherein rapid color changes are required.

A still further problem with systems of the type disclosed in the Wiggins U.S. Pat. No. 4,313,475 is that they cannot be used with coating materials whose application characteristics are improved when dispensed at elevated temperatures. In systems of this type, it is not feasible to use a coating material heater because no provision is made to recirculate the coating material from the coating dispensers back to the source when the coating dispensers are not in use. Absent recirculation, the coating material could not be held at sufficient temperature if the spraying operation were interrupted or discontinued for a period of time. Additionally, in systems of the type disclosed in Wiggins U.S. Pat. No. 4,313,475, any heater utilized would have to be positioned in the loop between the source of coating material and inventory vessel to isolate the heater from the electrostatic power supply and avoid grounding of the system. At this location, the heater is physically removed from the coating dispensers and could not effectively maintain temperature of the coating material unless the system was always operated continuously.

SUMMARY OF THE INVENTION

It is therefore among the objectives of this invention to provide a method and apparatus for dispensing electrically conductive coating materials, such as water-based paint, which protects against the transmission of an electrostatic charge between the high voltage electrostatic power supply and the primary coating supply, which is capable of incorporating a heater without grounding the system and without requiring continuous dispensing of coating material, which permits the operation of multiple hand-held or manually operated coating dispensers without the risk of electrical shock from such dispensers when not in use, and which incorporates color changers without requiring time-consuming cleaning between color changes.

These objectives are accomplished in an apparatus for transferring electrically conductive coating materials, such as water-based paint, from at least one source to one or more coating dispensers or spray guns for discharge onto a substrate. In alternative embodiments, the apparatus of this invention provides a "voltage block", i.e., an air gap, between one or more sources of coating material and electrostatically charged coating material which is directed to the spray guns. This voltage block ensures that there is never an electrical path between the source of water-based paint and the charged coating material during a coating operation. In one presently preferred embodiment, a secondary voltage block is provided between each of a number of individual spray guns and the charged coating material so that each spray gun can be electrically isolated from the charged coating material when not in use. Alternative embodiments incorporate color changers which provide for easy cleaning of the system, and optionally include a heater which is electrically isolated from the charged coating material and is effective to elevate the temperature of the coating material prior to discharge from the spray guns.

One presently preferred embodiment of this invention is provided with a number of advantageous features, including: (1) a single high voltage electrostatic power supply capable of imparting an electrostatic charge directly to the coating material which is then supplied to a number of spray guns; (2) means for isolating the source of one or more coating materials from the high voltage electrostatic power supply; and, (3) means for electrically isolating each of a number of individual coating dispensers or spray guns from the high voltage power supply when not in use.

Electric isolation of the source(s) of water-based paint from the high voltage electrostatic power supply is achieved in this embodiment with a "voltage block" construction which includes a first shuttle device connected to the reservoir of a first piston pump, and a second shuttle device connected to the reservoir of a second piston pump. The first shuttle device is movable with respect to a filling station, which is connected to a source(s) of water-based paint, between a transfer position coupled to the filling station and a neutral position physically spaced or separated by an air gap from the filling station. The second shuttle device is movable with respect to a transfer station, which is connected to the reservoir of the first piston pump, between a transfer position coupled to the discharge station and a neutral position spaced from the discharge station. The second shuttle device is connected to the reservoir of the second piston pump, which, in turn, communicates through a feed line with a number of spray guns.

In this embodiment of the invention, a high voltage power supply is connected through an electrostatic cable to the metal housing of the second piston pump such that all of the water-based paint directed into the second piston pump from the transfer station, and discharged therefrom, is imparted with an electrostatic charge. This charged water-based paint is then supplied through the feed line to a number of individual spray guns for deposition onto a substrate. In this embodiment of the invention, the electrostatics are not supplied via an electrostatic cable or the like to each spray gun individually, but, instead, the coating material is charged upstream from the spray guns and distributed to each spray gun individually as needed.

Movement of the first and second shuttle devices is controlled such that a voltage block or air gap is continuously maintained between one or more sources of water-based paint, and the electrostatic power supply connected to the second piston pump. This voltage block is obtained by ensuring that when the first shuttle device is coupled to the filling station for transfer of coating material from a source into the first piston pump, the second shuttle device is electrically isolated, i.e., placed in the physically spaced, neutral position, with respect to the transfer station which is connected to the second piston pump. A second voltage block is provided during transfer of the water-based paint from the reservoir of the first piston pump into the reservoir of the second piston pump by moving the first shuttle to its neutral position with respect to the filling station so that a physical air gap is obtained between the first piston pump and the source(s) of coating material. When the reservoir of the second piston pump is filled, the shuttles return to their original positions, i.e., the first shuttle couples with the filling station to resume transmission of coating material into the first pump reservoir while the second shuttle moves to its neutral position with respect to the transfer station. With the second shuttle in the neutral position, the source of water-based paint is isolated from the high voltage electrostatic power supply connected to the second piston pump, thus permitting the transfer of charged water-based paint from the second pump to the spray guns without the risk of transmitting an electrostatic charge to the paint source(s).

As mentioned above, National Fire Protection Code provisions require that the electrostatics to manually operated spray guns must be disconnected when the trigger of such guns is released. In order to meet this requirement, a separate voltage block structure is provided in this embodiment of the invention between the feed line from the second piston pump carrying charged water-based paint, and each of essentially any number of spray guns. Each voltage block structure includes a discharge shuttle connected to one of the spray guns, which is movable to a coupled position in engagement with a discharge station connected to the feed line from the second piston pump carrying charged water-based paint, and a neutral position physically spaced from the discharge station. When it is desired to spray water-based paint from any of the spray guns, depression of the trigger of a gun activates a pneumatically and/or mechanically operated valving system which causes the discharge shuttles to couple with the discharge station thus providing a path for the charged water-based paint directly to such spray gun. When the trigger of a spray gun is released, the valving system is operative to move the discharge shuttle associated with that gun to a neutral position thus creating a voltage block or air gap between the charged coating material at the discharge station and such spray gun Each spray gun is therefore electrically isolated from the charged water-based paint within the feed line until such time as its trigger is depressed to begin another spraying operation.

The aforementioned embodiment of this invention has several advantages. First, a voltage block construction is provided to continuously isolate one or more sources of water-based paint from the high voltage power supply which charges the water-based paint transmitted to the spray guns. Additionally, a single high voltage power supply is capable of servicing a number of individual spray guns, thus eliminating the need for separate electrostatic cables to each gun. A further advantage, particularly when operating manual spray guns with this system, is that a voltage block is provided between the feed line carrying charged coating material from the second piston pump and each of the individual spray guns. This ensures that each of the spray guns is electrically isolated when not in use, thus protecting operators against electrical shock hazards.

The above-described embodiment of this invention can be provided with additional features, depending upon the requirements of a particular application. For example, it has been found that the application characteristics of some types of water-based paints, and other highly conductive coating materials, are improved if they are dispensed at elevated temperatures. As discussed above, the incorporation of paint heaters within systems for dispensing water-based coatings had not been possible in prior art systems. This problem is overcome in this invention by the voltage block configuration incorporated between the coating source and high voltage power supply, as described above, and circulation lines associated with such system to provide for recirculation of the paint when it is not being dispensed from the spray guns. In the presently preferred embodiment, a paint heater, which is grounded, is preferably incorporated in a loop or line downstream from the source(s) of coating material but upstream from the voltage block. Because the voltage block continuously isolates the source of water-based paint from the high voltage power supply, the heater is never electrically connected to the high voltage power supply and therefore cannot ground the system. The water-based paint discharged from the source passes through the paint heater where its temperature is elevated, and then the heated paint enters the voltage block for supply to the spray guns. If the spray guns are not operating, a controller is effective to temporarily deactivate the high voltage power supply and then couple the first and second shuttles to the filling and transfer stations, respectively, thus providing a path for recirculation of the water-based paint back through the shuttles, and the filling and transfer stations, to the heater and paint source. This recirculation through the heater maintains the paint at the desired temperature, and also aids in preventing settling of the solid content of the paint.

Another feature which is readily adapted with this embodiment of the present invention is a color changer of essentially any commercially available type. Preferably, the color changer is interposed between a number of sources of coating material of different color, and the voltage block described above. When a particular color is required, the color changer is effective to supply the first piston pump and remaining elements of the voltage block with such colored paint which, in turn, is transmitted from the second piston pump to the individual spray guns. The remaining elements of the system are identical to that described above.

Another embodiment of this invention is predicated upon the same concept of providing a continuous voltage block between a source of water-based paint and the high voltage power supply which charges the coating material, but this embodiment is particularly adapted for applications such as automotive paint lines wherein rapid color changes are required. In this embodiment, a dedicated pump and voltage block construction, including a separate transfer station and shuttle, is provided for every color of paint which is to be applied.

In the simplest version of this embodiment, a filling station is connected to a source of water-based paint of one color, and a shuttle is movable with respect to the filling station between a coupled position and a neutral position. The shuttle, in turn, is connected to the reservoir of a piston pump which communicates with a single manually operated spray gun. A dedicated high voltage power supply is connected to the metal body of the piston pump, and through an electrical/pneumatic control system to the spray gun. When the spray gun is not being operated, the shuttle is movable to a coupled position with respect to the transfer station so that water-based paint from the paint source can be transferred into the reservoir of the piston pump. The high voltage power supply is turned off during this filling procedure by the electrical/pneumatic control. In response to depression of the trigger of the gun, the electric/-pneumatic control first causes the shuttle to move to a neutral position spaced from the transfer station, and then activates the high voltage power supply to charge the water-based paint within the reservoir of the piston pump. A voltage block is thus created between the source of water-based paint and the high voltage power supply, and, simultaneously, the charged coating material within the pump reservoir is transmitted to the spray gun for deposition on a substrate.

The above-described construction of this embodiment of the invention can be adapted for use with multiple colors, each from a separate source, while employing a single source of high voltage electrostatic power. In one alternative embodiment, each of a number of sources of different colored paint are connected to a separate, dedicated transfer station, shuttle and piston pump all carried within a grounded, electrically isolated cabinet. The several pumps within the cabinet are electrically connected to one another, e.g., by electrically conductive straps or the like, and the metal pump body of one of the pumps is connected by an electrostatic cable to a high voltage power supply. The reservoir of each piston pump within the cabinet is connected to a color changer located upstream from a number of manually or automatically operated spray guns. In this system, a voltage block is maintained between the several sources of water-based paint and the high voltage power supply in the same manner described above for a single gun system. In response to actuation of one or more of the spray guns, e.g., by depressing the trigger mechanism thereof, all of the shuttles within the cabinet are moved to a neutral position with respect to their associated transfer stations. This electrically isolates all of the piston pumps within the cabinet, which are electrically connected to the high voltage power supply, from each of the sources of different colored paint. The color changer receives the desired color of paint from one of the piston pumps and, in turn, supplies this color to one or more spray guns. In addition to the compact construction of this system and the use of a single electrostatic power supply, positioning of the color changer downstream from the piston pumps requires less flushing of the system and clean up when a color change is desired. Only the color changer and the lines interconnecting the color changer with the spray guns, must be cleaned when a color change is made. This reduces down time and the difficulty associated with a color change.

In a still further embodiment, the above-described system using multiple dedicated shuttles and piston pumps can be modified to alter the position wherein the coating material is charged. In the previous embodiment, an electrostatic cable from a high voltage power supply is connected to one of the piston pumps within a grounded cabinet and then straps electrically interconnect the several pumps within the cabinet. In this alternative embodiment, an electrostatic cable from a high voltage power supply is attached to the metal block of the color change manifold of the color changer downstream from the shuttles and piston pumps and upstream from one or more spray guns. An electrostatic charge is thus applied to the coating material as it passes through the color change manifold, instead of within the piston pumps. In either embodiment, one or more spray guns are efficiently supplied with essentially any desired number of different colors, with a voltage block being continuously maintained between the sources of such different colored paints and the charged coating material.

A still further embodiment of the dedicated shuttle and piston pump system herein is provided wherein each spray gun is electrically isolated from the charged paint when not in use. This embodiment employs the same system described in the initial embodiment discussed above, wherein a discharge station connected to the feed line carrying charged paint, and a shuttle movable relative to the discharge station, is provided for each individual spray gun. As described above, when the trigger of a gun is depressed, the discharge shuttle is coupled to the discharge station to supply charged paint to the spray gun and such flow of paint is terminated when the trigger is released causing the shuttle to return to a neutral position spaced from the discharge station.

DESCRIPTION OF THE DRAWINGS

The structure, operation and advantages of the presently preferred embodiment of this invention will become further apparent upon consideration of the following description taken in conjunction with the accompanying drawings, wherein:

FIG. 1A is an enlarged view in partial cross section of the connection between an electrostatic cable and pump body shown in FIG. 1;

DETAILED DESCRIPTION OF THE INVENTION

Figure 1:
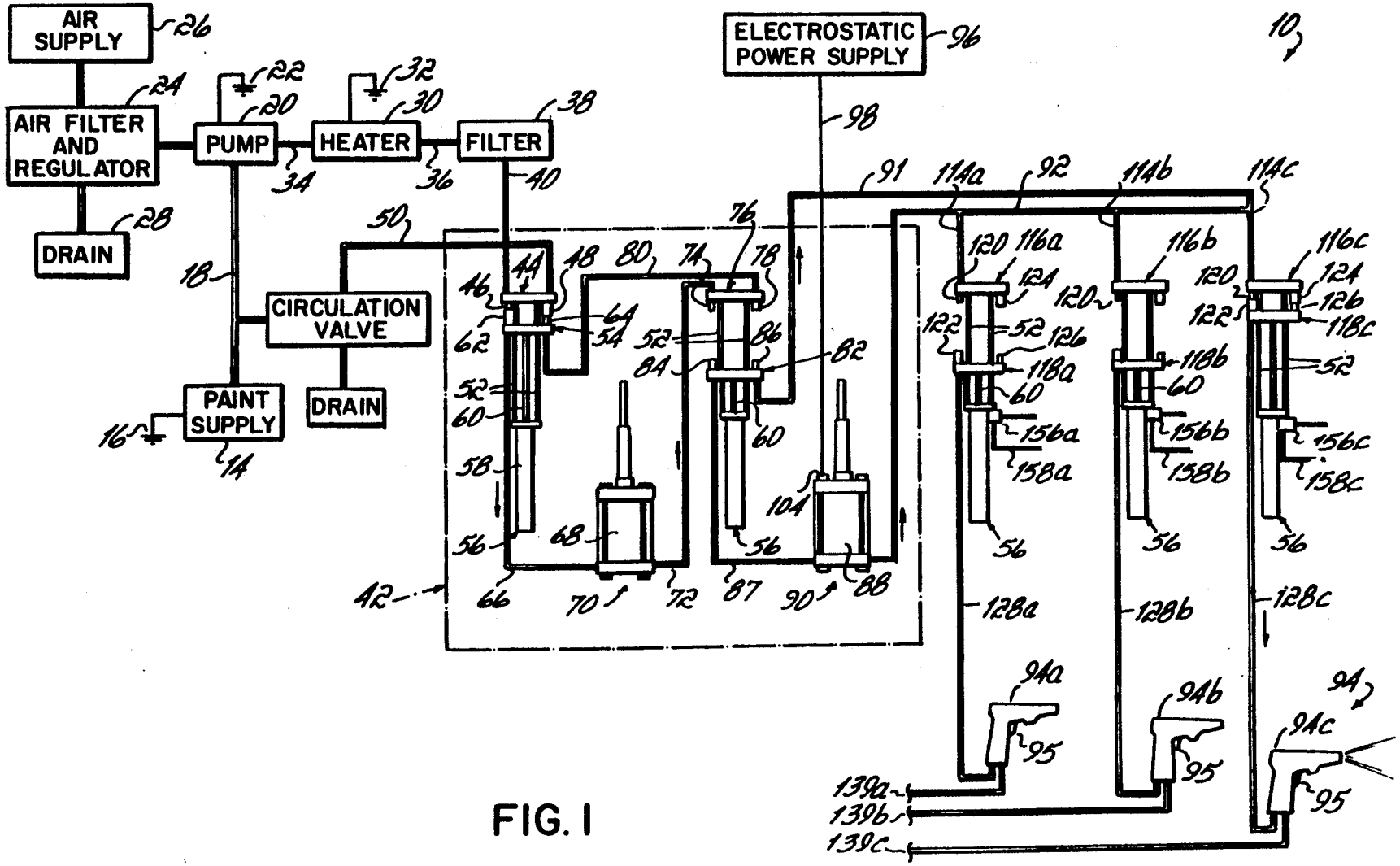
FIG. 1 is a diagrammatic view of the overall construction of one presently preferred embodiment of this invention.
Figure 2:
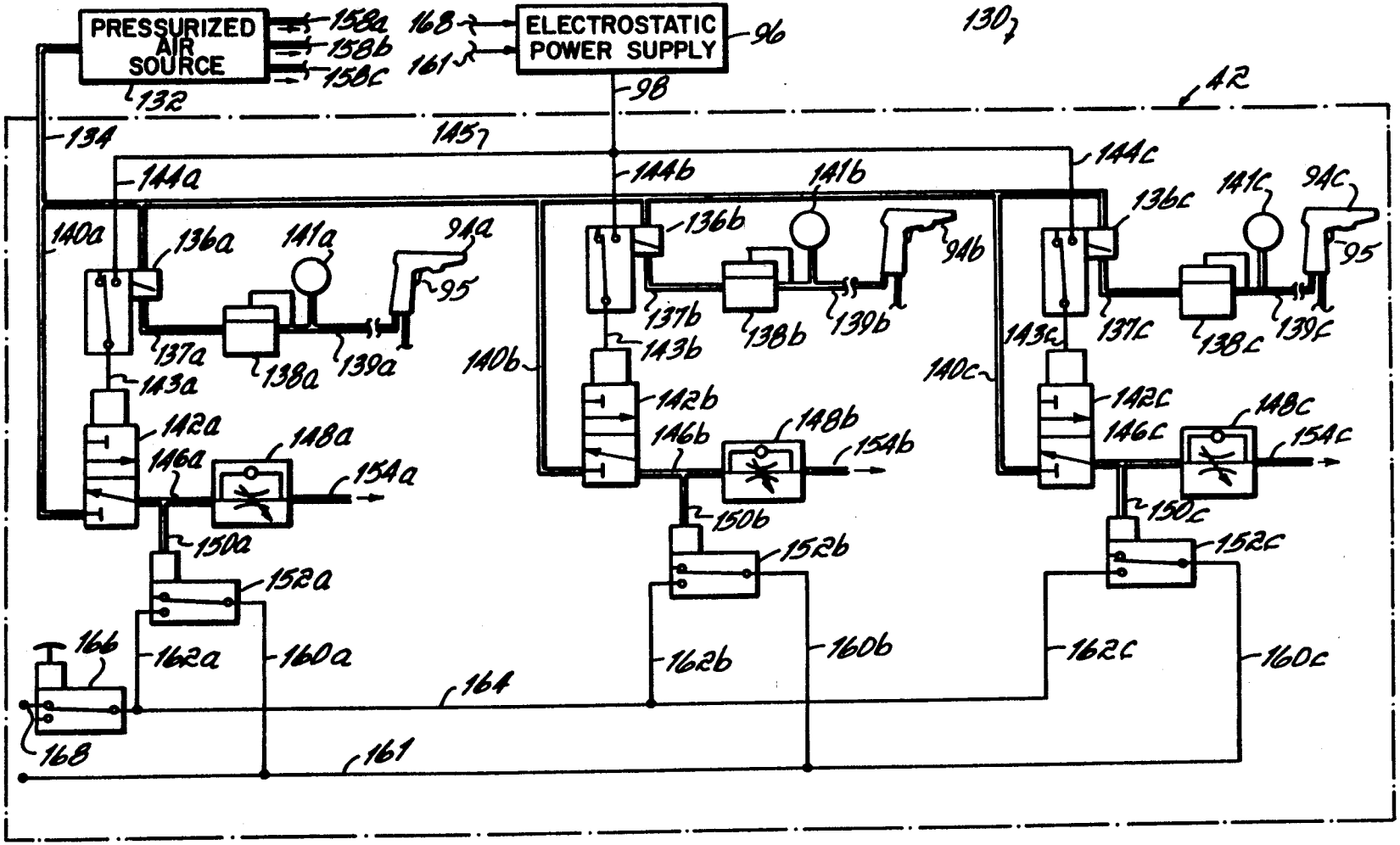
FIG. 2 is a schematic view of a portion of FIG. 1 illustrating the valving system employed to electrically isolate each of the spray guns from the electrostatic power supply.
Figure 3:
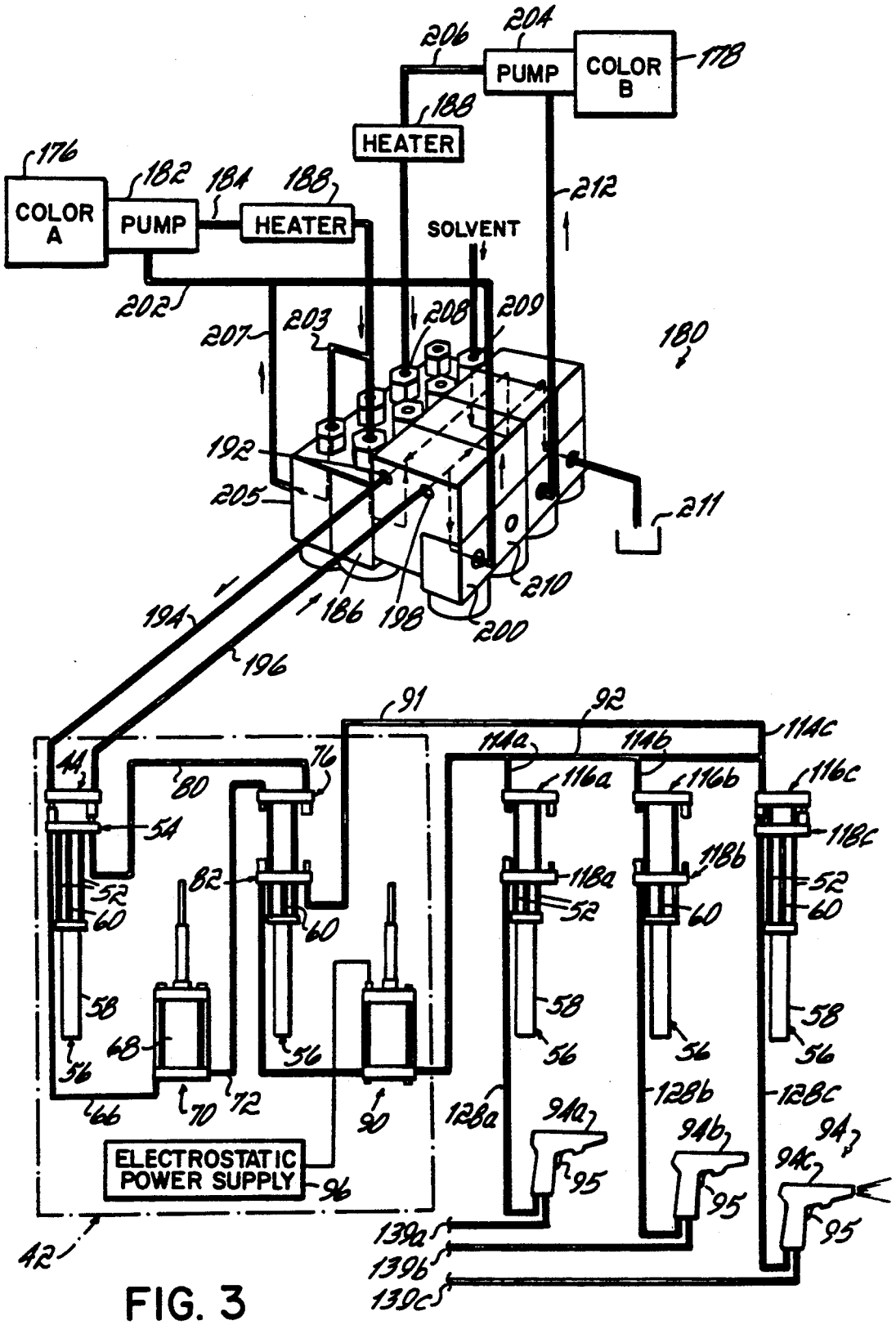
FIG. 3 is a view similar to FIG. 1 of an alternative embodiment incorporating a color change manifold.

Referring now to the Figs., an apparatus 10 is illustrated in FIGS. 1-3 and an apparatus 12 is illustrated in FIGS. 4-7 which are particularly adapted for use with highly electrically conductive coating materials such as water-based paints. The apparatus 10 and 12 are constructed to permit the transfer of such coating material from one or more sources, to one or more electrostatic spray guns, without creating an electrical shock hazard or loss of charge at the electrode in the spray gun caused by a ground at any of the equipment that is wetted by the coating material such as pumps, hoses and tanks. As discussed in detail below, the apparatus depicted in FIGS. 1-3 is particularly adapted for applications wherein the speed of a color change operation, i.e., changing from one color of water-based paint to another, is not a critical consideration. Apparatus 10 uses a relatively modest amount of equipment and is comparatively inexpensive to fabricate and maintain. The apparatus 12 of FIGS. 4-7, in the several variations thereof described below, is principally intended for use in applications where rapid color change is necessary such as in paint spraying lines for automobiles and other vehicles. The apparatus 12 employs additional equipment to achieve this end in comparison to that of apparatus 10.

The apparatus depicted in FIGS. 1-3, and their method of operation, are discussed initially followed by an explanation of the various embodiments depicted in FIGS. 4-7.

Apparatus of FIGS. 1 and 2: Single Paint Source and Multiple Guns

With reference to FIG. 1, the apparatus 10 comprises a source of highly electrically conductive coating material, depicted as paint supply 14, which is grounded at 16 and connected by a line 18 to a pump 20 grounded at 22. Pressurized air is supplied to pump 20 through an air filter and regulator 24 connected to an air supply 26 and a drain 28.

In the presently preferred embodiment, a paint heater 30, which is grounded at 32, is connected by a line 34 to the pump 20. This paint heater 30 is optionally included in apparatus 10 for situations wherein the application characteristics of a coating material such as paint are optimized by dispensing the material at elevated temperatures. As discussed below, the paint heater 30 is incorporated within the apparatus 10 at a location which avoids loss of charge at the coating dispensers or spray guns.

The paint is discharged from paint heater 30 through a line 36 into a filter 38 where any particles or other impurities are removed. From the filter 38, the paint travels through line 40 into a voltage block 42 which is collectively formed by the several elements illustrated within the dotted lines in FIG. 1. The voltage block 42 is disclosed in detail in U.S. patent application Ser. No. 07/554,795, filed Jul. 18, 1990 to Konieczynski, and entitled "Apparatus For Electrostatically Isolating Conductive Coating Materials", which is owned by the assignee of this invention and the disclosure of which is incorporated by reference in its entirety herein.

For purposes of the present discussion, the voltage block 42 comprises a filling station 44 having a male coupling element 46 connected to the line 40 from filter 36, and a spaced, female coupling element 48 connected to a line 50 which forms part of a recirculation loop described in detail below. The filling station 44 mounts a pair of spaced rods 52 along which a first shuttle 54 is axially slidable by operation of a pneumatic cylinder 56. The pneumatic cylinder 56 has a cylinder housing 58 mounted to the opposite sides of rod 52, and a cylinder rod 60 connected to the shuttle 54. In response to operation of cylinder 56, the shuttle 54 is moved along the rods 52 between a coupling or paint transfer position, and a neutral, physically spaced position, with respect to the filling station 44. In the presently preferred embodiment, the shuttle 54 carries a female coupling element 62 and a male coupling element 64 which are engageable with the male and female coupling element 46, 48, respectively, on the filling station 44 with the shuttle 54 in a transfer position. The detailed construction of these coupling elements forms no part of this invention, and is disclosed in U.S. patent application Ser. No. 07/554,795 now U.S. Pat. No. 5,078,168.

The female coupling element 62 of shuttle 54 is connected by a line 66 to the reservoir 68 of a first piston pump 70. The detailed construction of piston pump 70 forms no part of this invention per se and is thus not described herein. The pump reservoir 68 is connected by a line 72 to the male coupling element 74 of a transfer station 76. The transfer station 76 also includes a female coupling element 78 which is interconnected with the male coupling element of shuttle 54 by a circulation line 80. A second shuttle 82 is associated with transfer station 76, and this second shuttle 82 carries a female coupling element 84 and a male coupling element 86 which are matable with the male and female coupling elements 74, 78, respectively, of the transfer station 76 with the second shuttle 82 in a coupling or transfer position with respect to the transfer station 76. The structure for moving the second shuttle 82 with respect to the transfer station 76 is identical to that of first shuttle 54 including rods 52, and a pneumatic cylinder 56 having a cylinder housing 58 and cylinder rod 60. As viewed in FIG. 1, the female coupling element 84 of second shuttle 82 is connected by a line 87 to the reservoir 88 of a second pump 90, and the male coupling element 86 of second shuttle 82 is connected to a recirculation line 91. As described below, paint is discharged from the reservoir 88 of second pump 90 into a gun feed line 92 for supply to one or more spray guns 94.

The spray guns 94 are preferably air-type guns wherein atomization of the paint takes place by impacting a stream of paint with one or more jets of air These types of spray guns are available commercially, and one air-type electrostatic spray gun suitable for use with the apparatus 10 of this invention is a Model No. AN-9 sold by Nordson Corporation of Amherst, Ohio which is the assignee of this invention. Alternatively, the apparatus 10 can be adapted for use with airless-type electrostatic spray gun wherein atomization is obtained hydraulically, and one example of a suitable airless spray gun which can be used with apparatus 10 is found in U.S. Pat. No. 4,355,764, owned by the assignee of this invention.

In the presently preferred embodiment, a high voltage electrostatic power supply 96 is connected by an electrostatic cable 98 to a mounting stud 100 associated with second pump 90. As depicted in FIG. 1A, the terminal end 102 of cable 98 is held in place against the stud 100 by a nut 104 having an upper flange 106 which engages a ring 108 carried by the cable 98, and a threaded lower portion 110 which engages external threads formed on the exposed end of mounting stud 100. The cable 98 and power supply 96 are effective to impart a high voltage electrostatic charge to the metal body of pump 90, which, in turn, charges the coating material or paint within the pump reservoir 88. As a result, electrostatically charged paint is discharged from paint reservoir 88 into feed line 92 for supply to the spray guns 94.

The voltage block 42 is operative to transfer paint from the paint supply 14 to the reservoir 88 of second pump 90, which is electrically connected to the high voltage electrostatic power supply 96, so that a "voltage block" or air space is continuously maintained between the paint supply 14 and power supply 96. As described in detail in U.S. Pat. Ser. No. 07/554,795, the first shuttle 54 is movable to a transfer position with respect to filling station 44 to permit the transfer of paint from the paint supply 14 into the reservoir 68 of first pump 70. During this filling operation, a valving system (not shown) associated with the voltage block 42 ensures that an air space is provided between the paint supply 14 and second pump 90 by simultaneously moving the second shuttle 82 to a physically spaced, neutral position with respect to the transfer station 76. See FIG. 1. In order to transfer the paint to the reservoir 88 of the second pump 90, the first shuttle 54 is moved to a physically spaced, neutral position with respect to the filling station 44 and the second shuttle 82 is moved to a transfer position with respect to the transfer station 76. This permits the flow of paint from the reservoir 68 of first pump 70 through the transfer station 76 and second shuttle 82 to the reservoir 88 of second pump 90. Because the first shuttle 54 is in the neutral position relative to the filling station 44 during this transfer operation, a "voltage block" or air gap is maintained between the second pump 90 and paint supply 14. The position of shuttles 54, 82 is reversed in order to refill the reservoir 68 of first pump 70 after it has filled the second pump 90, and to supply the spray guns 94 with charged paint from the reservoir 88 of second pump 90.

An important aspect of the apparatus 10 of this embodiment is the provision of structure for electrostatically isolating each of a number of spray guns 94 from the charged paint emitted through line 92 from the reservoir 88 of second pump 90. As shown on the right-hand portion of FIG. 1, this line 92 is connected by branch lines 114*a, b, c* to a separate discharge station 116*a, b, c* associated with the three spray guns 94*a, b, c*, respectively, depicted in FIG. 1. Each of the discharge stations 116*a, b, c*, and the structure downstream therefrom to the spray guns 94*a, b, c*, is identical and therefore only one set of such elements associated with spray gun 94*a* are described herein, it being understood that the elements associated with guns 94*b* and *c* are structurally and functionally identical. Such other structure is given the same reference numbers with the addition of the letters "b" and "c" as illustrated in FIG. 1.

With reference to the first discharge station 116*a*, and its associated spray gun 94*a*, such discharge station 116*a* is connected by the branch line 114*a* to the line 92 from second pump 90. A discharge shuttle 118*a* is axially movable with respect to the discharge station 116*a* in the same manner as described above in connection with shuttles 54 and 82, i.e., the cylinder rod 60 of a pneumatic cylinder 56 is connected to the discharge shuttle 118*a* to move it along rods 52 which are connected between the discharge station 116*a* and the cylinder housing 58 of pneumatic cylinder 56. The discharge shuttle 118*a* has a male coupling element 126 matable with the female coupling element 124 carried by the discharge station 116*a*, and mating female and male coupling elements 122, 120 are carried by the discharge shuttle 118*a* and discharge station 116*a*, respectively. The male coupling element 120*a* of discharge station 116*a* is connected to branch line 114*a*, and the mating, female coupling element 122 carried by discharge shuttle 118*a* is connected by a discharge line 128*a* to the spray gun 94*a*.

With the discharge shuttle 118*a* in the physically spaced, neutral position as depicted in FIG. 1, the spray gun 94*a* is electrically isolated from the high voltage electrostatic power supply 96, second pump 90 and the line 92 carrying the electrostatically charged paint. On the other hand, the spray gun 94*c*, for example, is electrically connected to the power supply 96 via the second pump 90 and line 92 by movement of its discharge shuttle 118*c* to the transfer position with respect to discharge station 116*c*. In this position, the male and female coupling elements 120, 122 permit the passage of charged paint from the discharge station 116*c* through the discharge shuttle 118*c* and discharge line 128*c* to the spray gun 94*c* for deposition onto a substrate.

With reference to FIG. 2, a control system 130 is provided with the apparatus 10 of this invention which operates the discharge shuttles 118*a, b, c* and power supply 96 in response to actuation of the spray guns 94*a, b, c*. This control system is in addition to the pneumatic/mechanical valving arrangement mentioned above in connection with voltage block 42, which is described in detail in patent application Ser. No. 07/554,795. The control system 130 comprises a separate set of control elements for each of the spray guns 94*a, b, c* except for a common source of pressurized air 132 and the common power supply 96. The control elements associated with spray gun 94*a* are described in detail herein, it being understood that the same control elements associated with spray guns 94*b* and *c* are structurally and functionally identical, and are given the same reference numbers in FIG. 2 with the addition of the letters "b" and "c".

The pressurized air source 132 is connected by a pneumatic trunk line 134 to a flow switch 136*a* which is connected by line 137*a* to a pressure regulator 138*a*. The pressure regulator 138*a*, in turn, is connected by an air line 139*a* to spray gun 94*a* which provides atomizing air to the spray gun 94*a*. As schematically depicted in FIG. 2, a gauge 141*a* is preferably located within the air line 139*a* downstream from pressure regulator 138*a*. An air line 140*a* interconnects the trunk line 134 carrying the pressurized air with a solenoid valve 142*a*. The solenoid valve 142*a* is electrically connected to the flow switch 136*a* by a line 143*a*. In turn, the flow switch 136*a* is connected by an electric line 144*a* to a common electric line 145 from the power supply 96. The solenoid valve 142*a* is connected by an air line 146*a* to a control or restrictor valve 148*a*, and by an air line 150*a* to a pressure switch 152*a*. The restrictor valve 148*a* is connected by an air line 154*a* to the pilot (not shown) of a valve 156*a* associated with discharge shuttle 118*a*. See FIG. 1. This valve 156*a* receives a constant flow of pressurized air through line 158*a* from the pressurized air source 132.

In the presently preferred embodiment, one side of pressure switch 152*a* is connected by an electric line 160*a* to a common electric line 161 from the power supply 96. The opposite side of pressure switch 152*a* is connected by a line 162*a* to a line 164 which is electrically connected to the other pressure switches 152*b*, 152*c*, and to an on/off power switch 166. The opposite side of on/off power switch 166 is connected by line 168 to the power supply 96.

The purpose of the above-described elements of control system 130 is to control the supply of electrostatics to the spray gun 94*a* so that it is electrically isolated from the power supply 96 when not in use, i.e., when not spraying coating material or paint. The operation of control system 130 is as follows. Pressurized air from source 132 is continuously present, at system pressure, within the spray gun 94*a* via a flow path through the flow switch 136*a*, line 137*a*, pressure regulator 138*a* and line 139*a*. In response to actuation of the spray gun 94*a*, such as by depressing its trigger 95 depicted schematically in FIG. 1, a flow of atomizing air is obtained through this flow path and out of the spray gun 94*a*. This movement of air is sensed within flow switch 136*a* causing it to close the circuit between the power supply 96, flow switch 136*a*, electric line 143*a* and solenoid valve 142*a* which, in turn, closes the solenoid valve 142*a*. With the solenoid valve 142*a* closed, pressurized air from air source 132 flows through air line 140*a* to the restrictor valve 148*a* and to the pressure switch 152*a*. The restrictor valve 148*a* discharges pressurized air to the pilot of valve 156*a* associated with discharge shuttle 118*a*, allowing the pressurized air supply to such valve 156 through line 158*a* to actuate the pneumatic cylinder 56 causing cylinder rod 60 to advance the discharge shuttle 118*a* to the transfer position with respect to the discharge station 116*a*. As discussed above, this forms a completed flow path for the paint from second pump 90 and feed line 92 to the spray gun 94*a*. The pressurized air discharged from solenoid valve 142*a* to the pressure switch 152*a* causes the pressure switch 152*a* to close and send an electrical signal to the on/off power switch 166. This power switch 166, in turn, sends an electric signal through line 168 to the power supply 96 which activates the power supply 96 causing a high voltage electrostatic charge to travel through electrostatic cable 98 to the second piston pump 90. Electrostatically charged paint is emitted from the second pump 90 and transferred between the interconnected discharge station 116*a* and discharge shuttle 118*a* to the spray gun 94*a* for deposition onto a substrate.

An important aspect of the control system 130 is that the above-described sequence of operation is individually applicable to each of the spray guns 94*a, b* and *c* such that they are connected to the electrostatics of the system only when actuated, and electrically isolated when not in use. Since the pressure switches 152*a, b, c* associated with the respective spray guns 94*a, b, c* are each commonly connected to the single power switch 166, actuation of any one of the spray guns 94*a, b, c* activates the power supply 96 causing an electrostatic charge to be transmitted to the second pump 90. This ensures that even when only one of the spray guns 94*a, b, c* is operated, charged coating material will be provided to it from the second pump 90.

One feature of control system 130 which is advantageous, particularly in using manually operated spray guns 94*a, b, c*, is the inclusion of the control or restrictor valves 148*a, b, c* which provide the signal or pilot air to the valves 156*a, b, c* associated with each discharge shuttle 118*a, b, c*. The purpose of the restrictor valve 148 is to provide the operator with a brief delay period, i.e., when the trigger is not depressed, before the electrostatics to the spray guns 94*a, b* or *c* are cut off. The pressurized air supplied to the restrictor valve 148*a* from solenoid valve 142*a*, for example, takes several seconds to bleed off before the pressure lowers to a sufficient extent to cause the pilot associated with valve 156*a* of discharge shuttle 118*a* to reverse the direction of air flow through valve 156*a* and thus force the shuttle 118*a* to disengage from discharge station 116*a* and return to a physically separated, neutral position. In making manual spray operations, the operator is thus permitted to shift position or briefly stop the operation of spray gun 94*a* and then restart the paint flow without interrupting the electrostatics associated with such spray gun 94*a*.

The electrostatics of apparatus 10 are shut down completely when all of the spray guns 94*a, b, c* are not operated for a period of time, e.g., longer than a few seconds, as follows. With each gun 94*a, b, c* non-operational, the flow of air through flow switches 136*a, b, c* is stopped causing such switches 136*a, b, c* to open. This interrupts the electric signal to solenoid valves 142*a, b, c*, which, in turn, stop the flow of air to pressure switches 152*a, b, c*. This opens pressure switches 152*a, b, c*, thus interrupting the signal to the on/off power switch 166 which shuts down electrostatic power supply 96. As a result, the paint within pump 90, and the elements downstream therefrom, are uncharged.

In another aspect of the apparatus 10 of FIGS. 1–3, it is recognized that the pigments and other solid content of many highly conductive coating materials such as water-based paint tend to settle if allowed to stagnate over a given period of time. The apparatus 10 is constructed to avoid this problem by providing for recirculation of the coating material between the paint supply 14 and discharge stations 116*a, b* and *c* when none of the spray guns 94*a, b* or *c* are operating. In order to obtain such recirculation, each of the spray guns 94*a, b* and *c* must be non-operational, i.e., with their triggers open, so that each of the discharge shuttles 118*a, b* and *c* are moved to the neutral position physically spaced from the discharge stations 116*a, b* and *c*, respectively. This shuts down operation of the electrostatic power supply 96, as described above. At the same time, the control system for voltage block 42 moves each of the first and second shuttles 54 and 82 to a transfer position in a manner discussed in detail in U.S. patent application Ser. No. 07/554,795. With the shuttles 54 and 82 in this position, the recirculation line 91 is connected through second shuttle 82 to the transfer station 76. The female coupling element 78 of the transfer station 76, in turn, is connected by the line 80 to the first shuttle 54 coupled to the filling station 44. From the filling station 44, the coating material flows through circulation line 50 to a circulation valve 170 located outside of the voltage block 42. This circulation valve 170 is connected to a drain 172, and by a line 174 to the supply line 18 between the paint supply 14 and pump 20. A recirculation flow path is therefore provided from the pump 20, voltage block 42 and the discharge stations 116*a, b, c*, and then back through the voltage block 42 and circulation valve 170 to the inlet of pump 20. The pump 20 continuously operates to provide for constant movement of the water-based paint while the spray guns 94*a, b* and *c* are not operated. As soon as one or more of the spray guns 94*a, b* and *c* resume operation, the voltage block 42 and discharge shuttles 118*a, b* and *c* are operated as described previously.

Paint Heater

Another aspect of the embodiment of FIGS. 1 and 2 described above is its adaptability for use with a paint heater 30 in situations where the application characteristics of the paint are improved when dispensed at elevated temperatures. Two aspects of the apparatus 10 of FIGS. 1 and 2 make it adaptable for use with paint heater 30. In one aspect, all of the elements in the loop upstream from the voltage block 42, including the paint supply 14, pump 20, heater 30, filter 36 and recirculation valve 170 are continuously electrically isolated from the electrostatic power supply 96. As described above, the voltage block 42 is operative to position one of the shuttles 54 and 82 at a neutral or physically spaced position with respect to their associated filling and transfer stations 44, 76, respectively, whenever the electrostatic power supply 96 is activated. The heater 30 is therefore continuously electrically isolated from the electrostatic power supply 96 so that it cannot ground the system electrostatics. The second aspect of apparatus 10 which lends itself to use with heater 30 is the provision of a recirculation flow path for the paint as described above. This recirculation flow path not only prevents the solid content of the paint from settling, but permits recirculation of the paint through the heater 30 so that the elevated temperature of the paint can be maintained even when it is not being dispensed from the spray guns 94*a, b, c*. Without this recirculation capability, all of the paint downstream from heater 30 would cool while the spray guns 94*a, b, c* were not operating, thus adversely affecting the application characteristics of the paint.

Apparatus of FIG. 3: Multiple Paint Sources and Multiple Guns

An alternative embodiment of the apparatus 10 is illustrated in FIG. 3 which is adapted for use with multiple colors, the number and types of which are determined by a given application. Referring to FIG. 3, a color A supply 176 and a color B supply 178 are schematically depicted for purposes of illustrating this invention, it being understood that essentially any number of different colored paints could be utilized depending upon the capacity of a particular color changer. In the illustrated embodiment, a color changer 180 is interposed between the supplies 176, 178, and a voltage block 42 which is described in detail in connection with FIGS. 1 and 2. All of the elements within voltage block 42, and those elements downstream therefrom, are identical in structure and function to those illustrated in FIGS. and 2 and described below. The same reference numbers are therefore used in FIG. 3 to identify the same structure shown in FIGS. 1 and 2. The color changer 180 is preferably of the type disclosed in U.S. Pat. No. 4,657,047 to Kolibas, owned by the assignee of this invention, the disclosure of which is incorporated by reference in its entirety herein. The detailed structure and operation of color changer 180 form no part of this invention, and are therefore only briefly mentioned herein.

The color A supply 176 is connected to a pump 182 which, in turn, is connected by a supply line 184 to one of the bypass valves 186 of the color changer 180. Preferably, a heater 188 is mounted in the supply line 184 between the pump 182 and color changer 180. Internal valving (not shown) within the color changer 180 interconnects the bypass valve 186 with a universal paint supply manifold 192 which is connected by a line 194 to the filling station 44 of voltage block 42. In the event the spray guns 94*a, b* and *c* are not operated, provision is made for recirculation of the color A paint back out of the voltage block 42, in the manner described above, and then through a line 196 to the universal paint return manifold 198 of color changer 180. The recirculating color A paint is transmitted through the color changer 180 by internal valving (not shown) where it is discharged from a color module 200 into a return line 202 connected to the pump 182. As described in U.S. Pat. No. 4,657,047, the color A supply may also be provided with a return loop comprising a line 203 connected to the supply line 184 upstream from color changer 180, which line 203 is connected through a bypass valve 205 and line 207 to the return line 202. This return loop is utilized to recirculate color A paint when another colored paint is being dispensed, and a similar return loop is provided for each different colored paint supply.

After a paint operation has been completed with the color A paint, solvent is introduced into a bypass valve 209 of the color changer 180, in the manner described in detail in U.S. Pat. No. 4,657,047, and then flows through the line 194 through the remainder of the apparatus 10 described in connection with FIGS. 1 and 2 and depicted on the righthand portion of FIG. 3. The solvent also flows through the line 196 and universal paint return manifold 198 to a dump container 211 which ensures that the color changer 180, and the entire system downstream therefrom, are cleaned of the color A paint. Painting can then proceed with the color B paint, or any other color paint, in the same manner as described above in connection with paint color A. The color B supply 178 is connected to a pump 204 which feeds color B paint through a supply line 206 to a second bypass valve 208 in the color changer 180. A heater 188 is preferably included in supply line 206. Paint color B passes through the color changer 180 and is discharged from the universal paint supply manifold 192 through line 194 to the voltage block 42 as described above. During recirculation of paint color B, the line 196 transmits such color B paint into the universal paint return manifold 198 for passage through the color changer 182, a second color module 210 and then a return line 212 to the pump 204. The apparatus 10 as depicted in FIG. 3 is therefore capable of dispensing essentially any number of different colored paints using a single electrostatic power supply 96, while providing an effective voltage block between the power supply 96 and each of the paint sources 176, 178 as well as between the power supply 96 and each of the individual spray guns 94*a, b* and *c*.

Embodiments of FIGS. 4–7

With reference to FIGS. 4–7, the apparatus 12 is depicted in various alternative embodiments each of which are particularly adapted for more rapid color changes than permitted with the apparatus 10 discussed above in connection with FIGS. 1–3. Apparatus 12 is particularly useful in applications such as the painting of automotive or other types of vehicle bodies wherein the painting line moves rapidly and a color change must be accomplished in a short period of time in order to maintain line speed. As described in detail below, this is achieved in apparatus 12 by providing a dedicated shuttle and pump for each of a number of sources of different colored paints which are selectively transmitted to a color changer for distribution to one or more spray guns. Only the color changer, the lines downstream therefrom and the spray guns must be cleaned with solvent in between color changes, and this can be done efficiently and quickly to accommodate the time constraints of applications such as vehicle painting lines.

Figure 4:
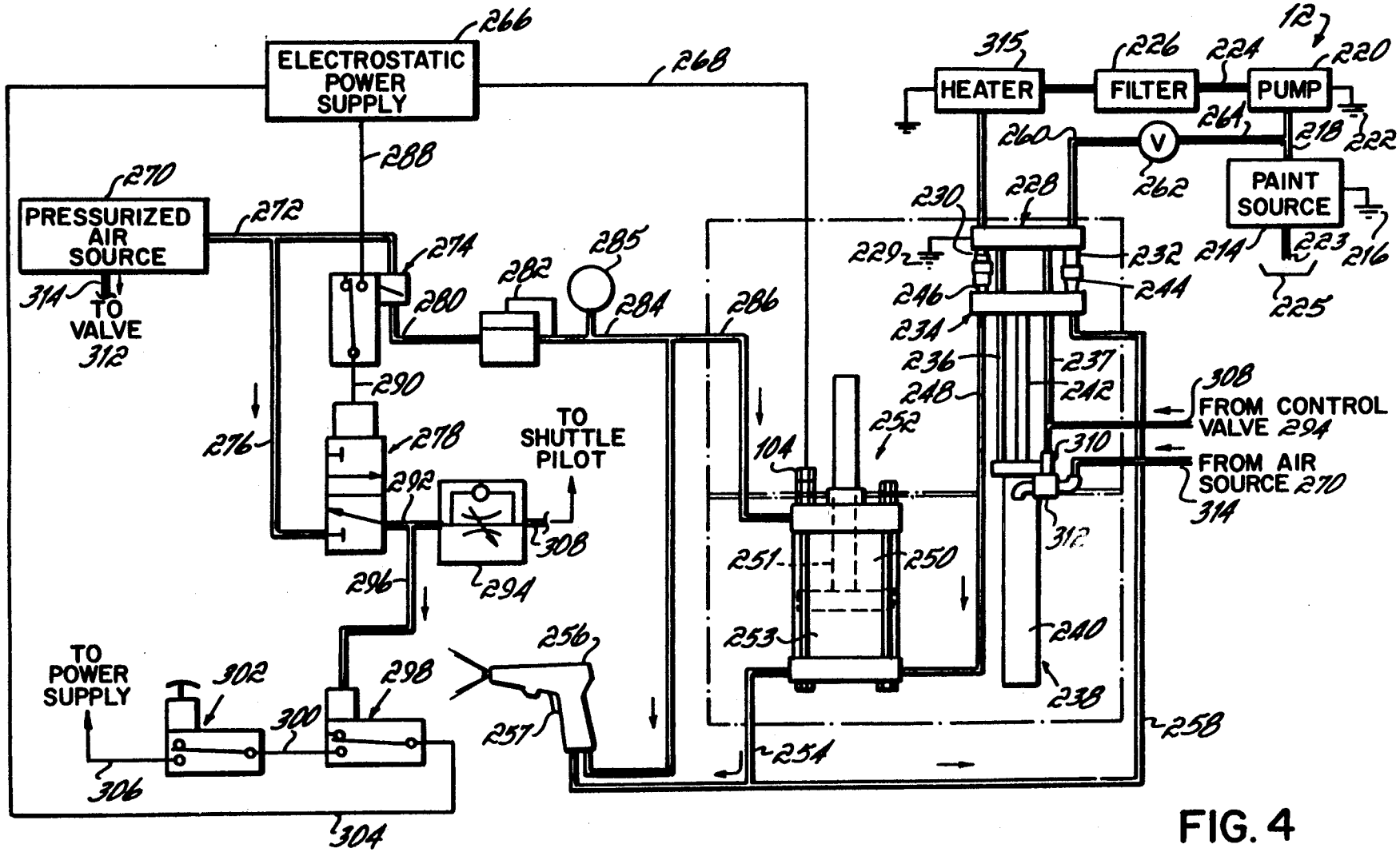
FIG. 4 is a diagrammatic view of the overall construction of an alternative embodiment of this invention.

Apparatus of FIG. 4: Single Paint Source and Spray Gun

With reference to FIG. 4, one embodiment of the apparatus 12 comprises a source of highly conductive coating material depicted as paint source 214 which is grounded at 216 and connected by a line 218 to a pump 220 grounded at 222 and by a line 223 to a dump container 225. The pump 220 is connected by a feed line 224, having a filter 226 mounted therein, to a male coupling element 230 carried by a filling station 228 which also mounts female coupling element 232.

A shuttle 234 is movable along a pair of rods 236, 237 relative to the filling station 228 by operation of a pneumatic cylinder 238. The rods 236, 237 extend between the filling station 228 and the cylinder housing 240 of the pneumatic cylinder 238, and this cylinder housing 240 carries a cylinder rod 242 mounted to shuttle 234. The shuttle 234 has male and female coupling elements 244, 246 which mate with the coupling elements 232 and 230, respectively, of the filling station 228. These coupling elements are the same type mentioned above in connection with a discussion of FIGS. 1-3, and are disclosed in detail in U.S. patent application Ser. No. 07/554,795. The pneumatic cylinder 238 is effective to extend and retract its cylinder rod 242 to move the shuttle 234 between a transfer position in which the coupling elements 244, 246 of shuttle 234 mate with the coupling elements 232, 230 of the filling station 228, and a neutral position in which the shuttle 234 is physically spaced from the filling station 228.

The female coupling element 246 of shuttle 234 is connected by a line 248 to the reservoir 250 of a piston pump 252 which carries a piston 251 shown in dashed lines in FIG. 4. As illustrated schematically in FIG. 4, the filling station 228 is grounded at 229 and is housed along with the shuttle 234 and piston pump 252 within a container 253 preferably formed of a dielectric material such as plastic. A supply line 254 extends from the pump reservoir 250, outwardly from container 253, to an electrostatic coating dispenser or spray gun 256 which is preferably of the same type as spray gun 94 discussed above in connection with FIGS. 1-3. A return line 258 is connected to the supply line 254 between the piston pump 252 and spray gun 256, and this return line is connected to the male coupling element 244 of shuttle 234 within the container 253. The female coupling element 232 of filling station 228, which mates with the male coupling element 244 of shuttle 234, is connected by a line 260 to a recirculation valve 262 which, in turn, is connected by a line 264 to the line 218 interconnecting the paint source 214 and pump 220. The return line 258, line 260, recirculation valve 262 and line 264 form a recirculation path for the water-based paint when the spray gun 256 is not operating, as discussed in more detail below.

With reference to the lefthand portion of FIG. 4, a control system is provided for imparting an electrostatic charge to the water-based paint flowing from the piston pump 252 to the spray gun 256, while ensuring that a voltage block or air gap is continuously maintained between the charged paint and the paint source 214. This control system includes a high voltage electrostatic power supply 266 which is connected by an electrostatic cable 268 to the piston pump 252 in the identical manner depicted in FIG. 1A and described above. When activated, as described below, the power supply 266 is effective to impart an electrostatic charge to the water-based paint within the pump reservoir 250 through the metal elements of pump 252 so that charged water-based paint is supplied to the spray gun 256. The remaining elements of the control system of this embodiment are similar to that depicted in FIG. 2 above. A source of pressurized air 270 is connected by a line 272 to a flow switch 274, and by a line 276 to a solenoid valve 278. The pressurized air from source 270 passes through flow switch 274 and into a line 280 connected to a pressure regulator 282. From the pressure regulator 282, the pressurized air is transmitted by a line 284, having a pressure gauge 285, to the spray gun 256. A branch line 286 is connected to line 284 and extends to the piston pump 252. The pressurized air from pressure regulator 282 and line 284 comprises the atomizing air for spray gun 256. The air from line 286 is required at the piston pump 252 to axially move its internal piston 251 within the reservoir 250 in order to discharge paint therefrom.

The electrostatic power supply 266 is connected by an electric line 288 to the flow switch 274 which, in turn, is connected by an electric line 290 to the solenoid valve 278. An air line 292 from the solenoid valve 278 is connected to a control valve 294, and a branch line 296 extends from the air line 292 to a pressure switch 298. This pressure switch 298 is connected by an electric line 300 to an on/off switch 302, and by an electric line 304 to the electrostatic power supply 266. The on/off switch is connected by a line 306 to the power supply 266.

The apparatus 12 of this embodiment operates as follows. In response to actuation of the spray gun 256, such as by depressing its trigger 257, the atomizing air supplied to the spray gun 256 from air source 270, and through flow switch 274 and pressure regulator 282, is permitted to move through the spray gun 256. This movement of air is sensed within the flow switch 274, which is connected to the pressure regulator 282, causing the flow switch 274 to close thus completing an electric circuit between the power supply 266, flow switch 274 and solenoid valve 278. The solenoid valve 278 is closed upon receipt of the signal from flow switch 274, which permits the passage of pressurized air from air source 270 and line 276 through the solenoid valve 278 to the control valve 294 and pressure switch 298.

The control valve 294 is connected by a line 308 to the pilot 310 of a valve 312 associated with the pneumatic cylinder 238 which controls the motion of shuttle 234. This valve 312 is constantly supplied with pressurized air from air source 270 through a line 314. When the spray gun 256 is not activated, the air flow through valve 312 causes the shuttle 234 to move to a transfer position coupled to the filling station 228 as shown in FIG. 4. In response to the supply of pilot air from control valve 294 to the pilot 310 of valve 312, i.e., when the spray gun 256 is activated as described above, the direction of air flow through valve 312 is reversed causing the pneumatic cylinder 238 to move the shuttle 234 to a physically spaced, neutral position with respect to the filling station 228. This creates an air gap between the paint source 214, and the piston pump 252 which is connected to the power supply 266. As the shuttle 234 is being moved to the neutral position, the pressurized air supplied from solenoid valve 278 to the pressure switch 298 closes the pressure switch 298 which sends an electric signal to the on/off switch 302. This signal closes the on/off switch 302 to complete a circuit activating the power supply 266 which provides a high voltage electrostatic charge through cable 268 to the piston pump 252. The water-based paint within the pump reservoir 250 therefore becomes charged due to contact with the metal housing of the piston pump 252 and is forced from the pump reservoir 250 through supply line 254 to the spray gun 256.

The control valve 294 of the control system described above is essentially the same as control valve 148 described above in connection with FIGS. 1-3. Should the operator release the trigger 257 of spray gun 256 for a few seconds, the electrostatics to the gun 256 are not disconnected because the control valve 294 allows the pressurized air supplied by line 308 to pilot 310 to bleed off slowly, therefore maintaining the direction of air flow through valve 312 which retains shuttle 234 in its neutral position spaced from the filling station 228. When operation of the spray gun 256 ceases for a longer period than a few seconds, the above-described operation of the control system reverses. Flow of atomizing air through the spray gun 256 stops which causes the flow switch 274 to open, thus disconnecting the circuit to solenoid valve 278. In turn, solenoid valve 278 opens which stops the flow of pressurized air to pressure switch 298 thus breaking the circuit to on/off switch 302. As a result, the power supply 266 is deactivated so that no electrostatic voltage is supplied to the piston pump 252. Closure of the solenoid valve 278 also stops the flow of pressurized air to the control valve 294 which, in turn, stops the flow of pressurized air to the pilot 310 of valve 312. The flow of air through valve 312 is therefore reversed, allowing the pressurized air from line 314 to cause pneumatic cylinder 238 to move the shuttle 234 to a transfer position with respect to the filling station 228.

As depicted in FIG. 4, with the shuttle 234 in a transfer position, the water-based paint flows through filling station 228 and shuttle 234 to refill the pump reservoir 250. When the pump reservoir 250 is filled, the paint exits the reservoir 250 through supply line 254 and then flows back through the return line 258 to the shuttle 234 and filling station 228. From the filling station 228, the coating material passes through line 260 and through recirculation valve 262 and line 264 back to the pump 220. A recirculation flow path is therefore provided in the apparatus 12 of FIG. 4 which is operative when the spray gun 256 is deactivated and aids in preventing settling of the solid content of the paint within the system. Additionally, such recirculation capability enables a paint heater 315 to be included in line 224, upstream from the filling station 228 as depicted in FIG. 4, to maintain the paint at an elevated temperature if desired.

Multiple Paint Sources and Spray Guns

The construction of apparatus 12 depicted in FIG. 4 includes a single paint source 214 and a single spray gun 256. This same construction can be essentially duplicated for a number of individual paint sources, each having a different color, to provide a system for supplying a variety of different colored paints to essentially any number of spray guns with minimum down time between color changes. The systems depicted in FIGS. 5–8 each provide for rapid color change from a number of individual sources, but each employ the same control system and voltage block depicted in FIG. 4 and described in detail above.

Figure 5:
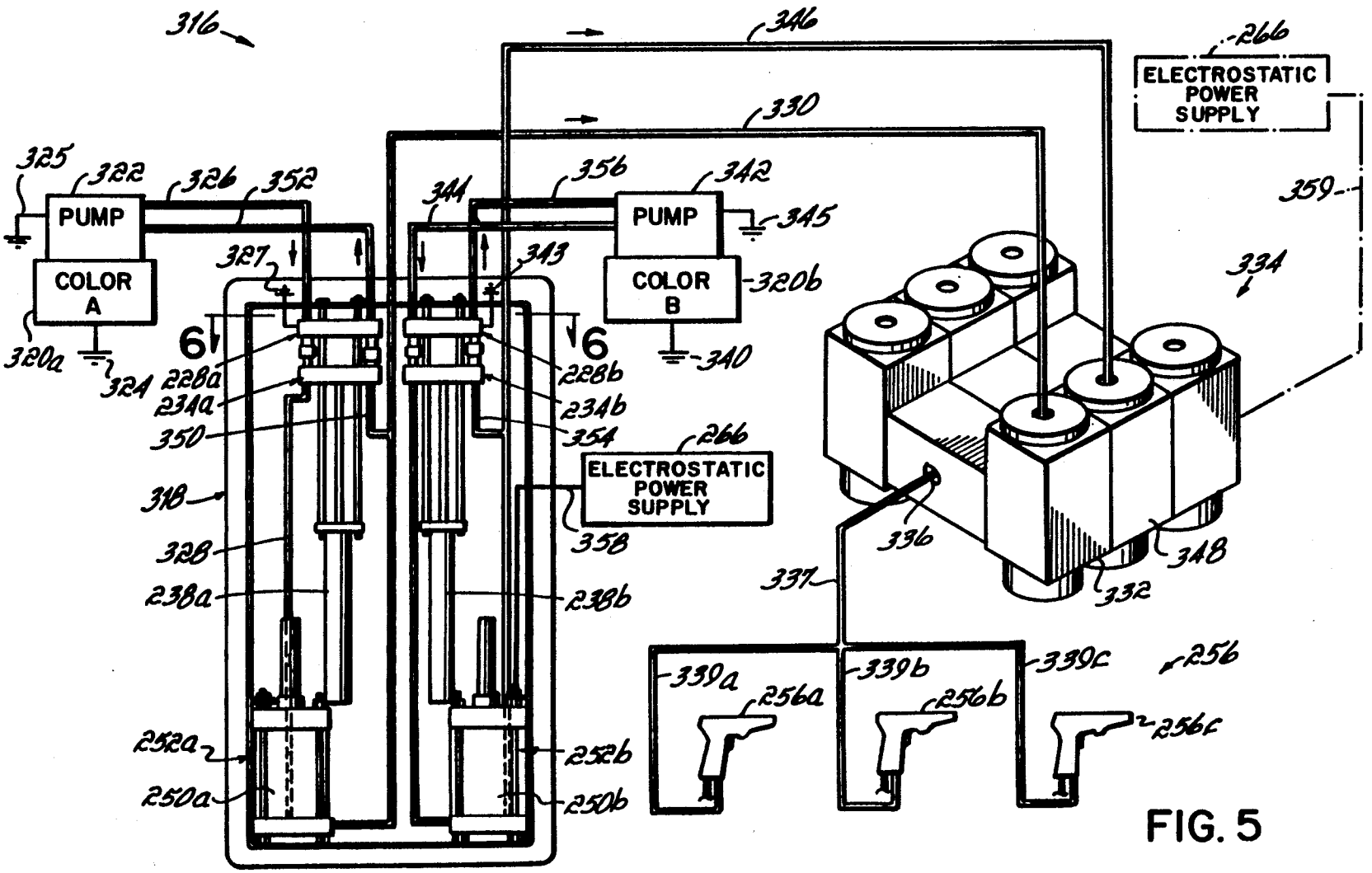
FIG. 5 is a schematic view of the system of FIG. 4 adapted for use with the number of different colors.
Figure 6:
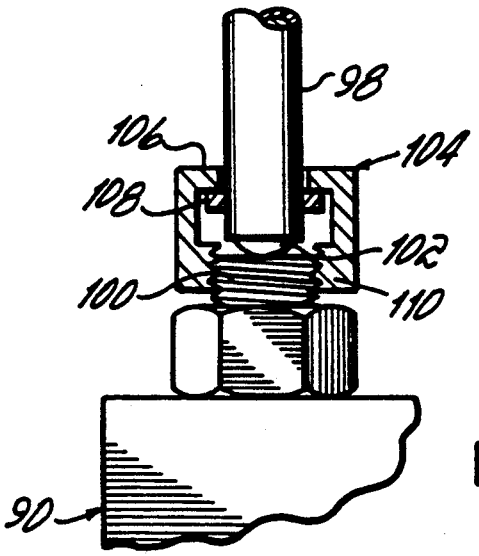
FIG. 6 is a plan view taken generally along line 6—6 of FIG. 5.
Figure 6:
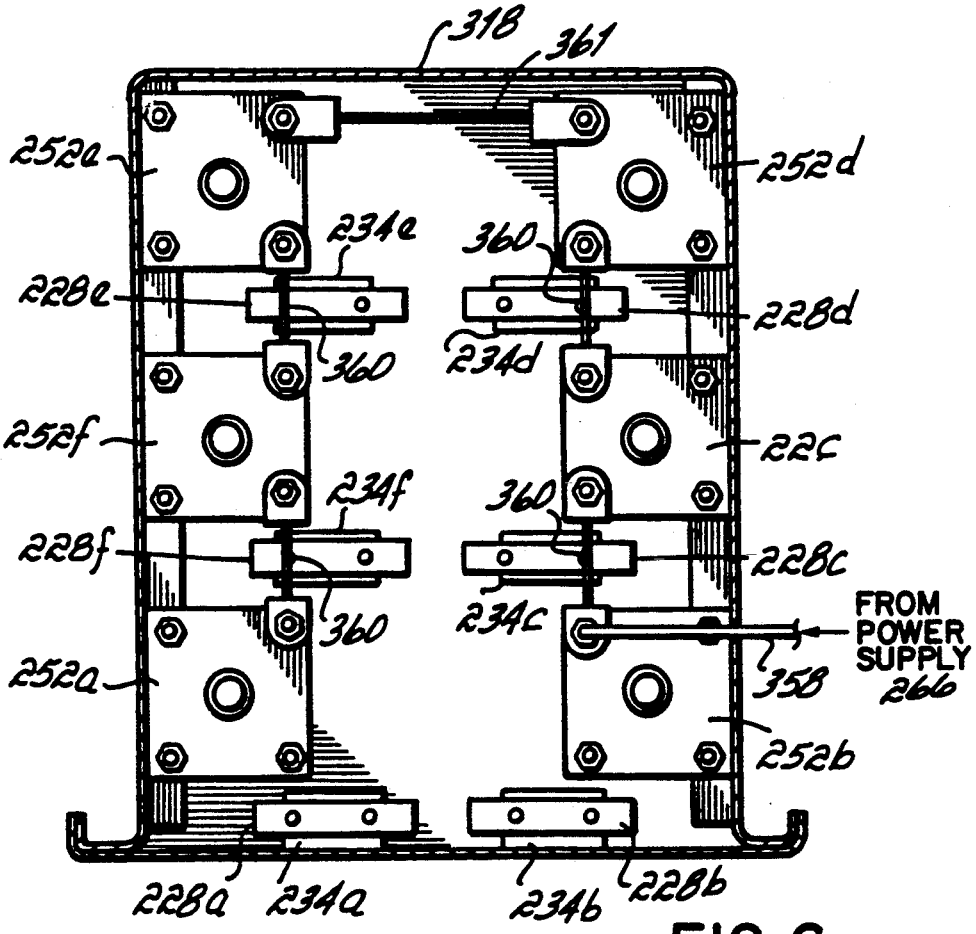

Embodiment of FIGS. 5 and 6

With reference to FIGS. 5 and 6, an apparatus 316 is illustrated comprising a housing 318, preferably formed of a dielectric material such as plastic, which carries a dedicated piston pump, shuttle and filling station for each of a number of water-based paint sources of different colors. The piston pump, shuttle and filling station associated with each paint source is identical to that described in connection with FIG. 4, and, for purposes of the present discussion, the same reference numbers used in FIG. 4 are applied to the same structure appearing in FIGS. 5 and 6 with the addition of the letters "A", "B", etc., corresponding to different colored paints.

The apparatus 316 is adapted for use with essentially any number of paint sources. For purposes of discussion, a color A paint source 320*a* and a color B paint source 320*b* are shown in FIG. 5, both of which are connected to a dedicated piston pump, shuttle and filling station. A total of six sets (FIG. 6) of dedicated piston pumps, shuttles and filling stations are depicted in FIG. 6, which is a view from the top of housing 318, to illustrate one manner of charging the different colored paints prior to transmission to the spray guns. It should be understood that the following discussion of the paint flow path of colors A and B is the same for any of the other colors to be dispensed from apparatus 316.

The "color A" paint source 320*a* is grounded at 324 and is connected to a pump 322 which is grounded at 325. The pump 322 is connected by a supply line 326 to a filling station 228*a* which is adapted to couple with a shuttle 234*a* using the same male and female coupling elements as described above in connection with FIG. 4. Preferably, the filling station 228*a* is grounded to the housing 318 at 327. A line 328 from shuttle 234*a* is connected to piston pump 252*a* having a reservoir 250*a* for receiving color A paint. The pump reservoir 250*a* is connected by a line 330 to a paint supply valve 332 of a color changer 334. This color changer 334 is preferably of the type disclosed in U.S. Pat. No. 4,830,055 to Kolibas, owned by the assignee of this invention, the disclosure of which is incorporated by reference in its entirety herein. The details of the structure and operation of color changer 334 form no part of this invention and are therefore not discussed herein. Internal valving within the color changer 334 transmits the color A paint from paint supply valve 332 through a paint supply manifold 336 to a common feed line 337 which is connected by branch lines 339*a, b, c* to a number of spray guns 256*a, b, c,* respectively, of the type discussed in connection with FIG. 4. While three spray guns 256*a, b, c* are shown, it should be understood that essentially any number of spray guns 256 could be utilized.

The identical construction is employed to supply a paint color B to spray guns 256*a, b, c.* As schematically depicted in FIG. 5, a color B paint source 320*b* is connected through a pump 342 and a supply line 344 to the filling station 228*b* which is grounded to the housing 318 at 343. Preferably, the color B paint source is grounded at 340 and the pump 342 is grounded at 345. In the identical manner described above, the color B paint is introduced into the reservoir 250*b* of piston pump 252*b,* and flows therefrom through a line 346 into a second paint supply valve 348 associated with color changer 334. The color B paint is discharged through the paint supply manifold 336 of color changer 334 and supplied by feed line 337 and branch lines 339*a, b, c* to spray guns 256*a, b, c.*

The apparatus 316 of FIGS. 5 and 6 also employs the same recirculation feature as that of apparatus 12 depicted in FIG. 4. As viewed in FIG. 5, the line 330 which interconnects the pump reservoir 250*a* to color changer 334 is connected by a branch line 350 to one side of the shuttle 234*b.* With the shuttle 234*b* coupled to the filling station 228*b,* as depicted in FIG. 5, color A paint from line 330 enters the branch line 350 and passes through the shuttle 234*a* and filling station 228*a* for recirculation back to the pump 322 via a return line 352, connected to filling station 228*a.* The identical construction is provided with respect to the supply of color B paint, wherein a branch line 354 is connected between the line 346 from piston pump 252*b* to color changer 334 and one side of the shuttle 234*b*. The color B paint flows through shuttle 234*b* and the filling station 228*b* back to pump 342 through a return line 356. In this manner, the paint associated with each of the individual sources 320*a* and *b*, or any other number of sources, is continuously recirculated when not being supplied to the color changer 334 for discharge to the spray guns 256.

The apparatus 316 of FIGS. 5 and 6 therefore comprises essentially a number of individual apparatus 12 described above and shown in FIG. 4, wherein a dedicated apparatus 12 is provided for each different colored paint. Accordingly, a control system having the identical control elements shown in FIG. 4 and described in detail above is employed to operate each of the dedicated shuttles 234*a, b* and their associated cylinders 238*a, b*. Such control system also operates a single electrostatic power supply 266 which is utilized to impart a high voltage electrostatic charge to each of the several different colors of paint. One addition to such control system is a common electric line (not shown) interconnecting the pressure switch 298 of each set of control elements with the common on/off switch 302. This common electric line functions in the same manner as line 164 described above in connection with the control system 130 of the embodiment of FIGS. 1–3.

In one presently preferred embodiment shown in solid lines in FIG. 5 and in FIG. 6, an electrostatic cable 358 from power supply 266 is connected to one of the piston pumps, e.g., piston pump 252*b*, in the identical manner shown in FIG. 1A and described above. A total of six piston pumps 252*a–f* are shown within housing 318 for purposes of illustrating the concept of this invention. These six piston pumps 252*a–f* are interconnected by electrically conductive straps 360, and a cross-over strap 361, so that the electrostatic charge from power supply 266 is transmitted to each of the piston pumps 252*a–f*. In an alternative embodiment shown in phantom in FIG. 5, an electrostatic cable 359 is connected to the metal body of color changer 334. In this embodiment, the paint is electrostatically charged in the course of passage through the color changer 334 instead of at the piston pumps 252*a–f*. In either embodiment, charged paint is emitted from color changer 334 to the spray guns 256*a, b, c*.

The operation of apparatus 316 proceeds in the same manner as described above for apparatus 12. When one or more spray guns 256*a, b, c* are activated, all of the shuttles 234*a–f* are moved to a physically spaced, neutral position with respect to their respective filling stations 228*a–f*. As soon as this voltage block is created, the power supply 266 is activated, as discussed above, which charges the water-based paint within each of the piston pumps 252*a–f* via electrostatic cable 358 and the interconnecting straps 360, 361, or within the color changer 334 via electrostatic cable 359. Depending upon which color is required, one of the piston pumps 252*a–f* is operated to discharge a water-based paint of desired color to the color changer 334 which discharges such color to the spray guns 256*a, b, c* through the paint supply manifold 336 and line 337. When a coating operation is completed for this particular color, the spray guns 256 are deactivated which, in turn, deactivates the power supply 266 and causes the shuttles 234*a–f* to return to a coupled, transfer station with respect to their associated filling stations 228*a–f*. In this transfer position, the pump reservoir 250 carrying the particular color which had just been sprayed is replenished with paint, while the paint within the other pump reservoirs 250 is recirculated as described above to avoid settling of their solid content.

One advantage of the apparatus 316 of this embodiment, whether the electrostatic charge is applied at the piston pumps 252*a–f* or at the color changer 334, is that rapid color change can be obtained This is attributable to two features of apparatus 12. First, a dedicated filling station 228, shuttle 234 and piston pump 252 is employed for each color, and these elements carry the same color throughout operation of the system. Additionally, the color changer 334 (FIG. 5) has a paint supply valve 332 for each of the separate colors supplied from a dedicated piston pump 252. Accordingly, when a color change is required, the only elements which must be cleaned are the universal internal passages of the color changer 334, as discussed in U.S. Pat. No. 4,830,055, the lines 337 and 339*a, b, c* downstream from the color changer 334 and the individual spray guns 256. The remainder of the apparatus 316, upstream from color changer 334, need not be cleaned. As a result, the cleaning operation can be performed rapidly with minimum down time.

Figure 7:
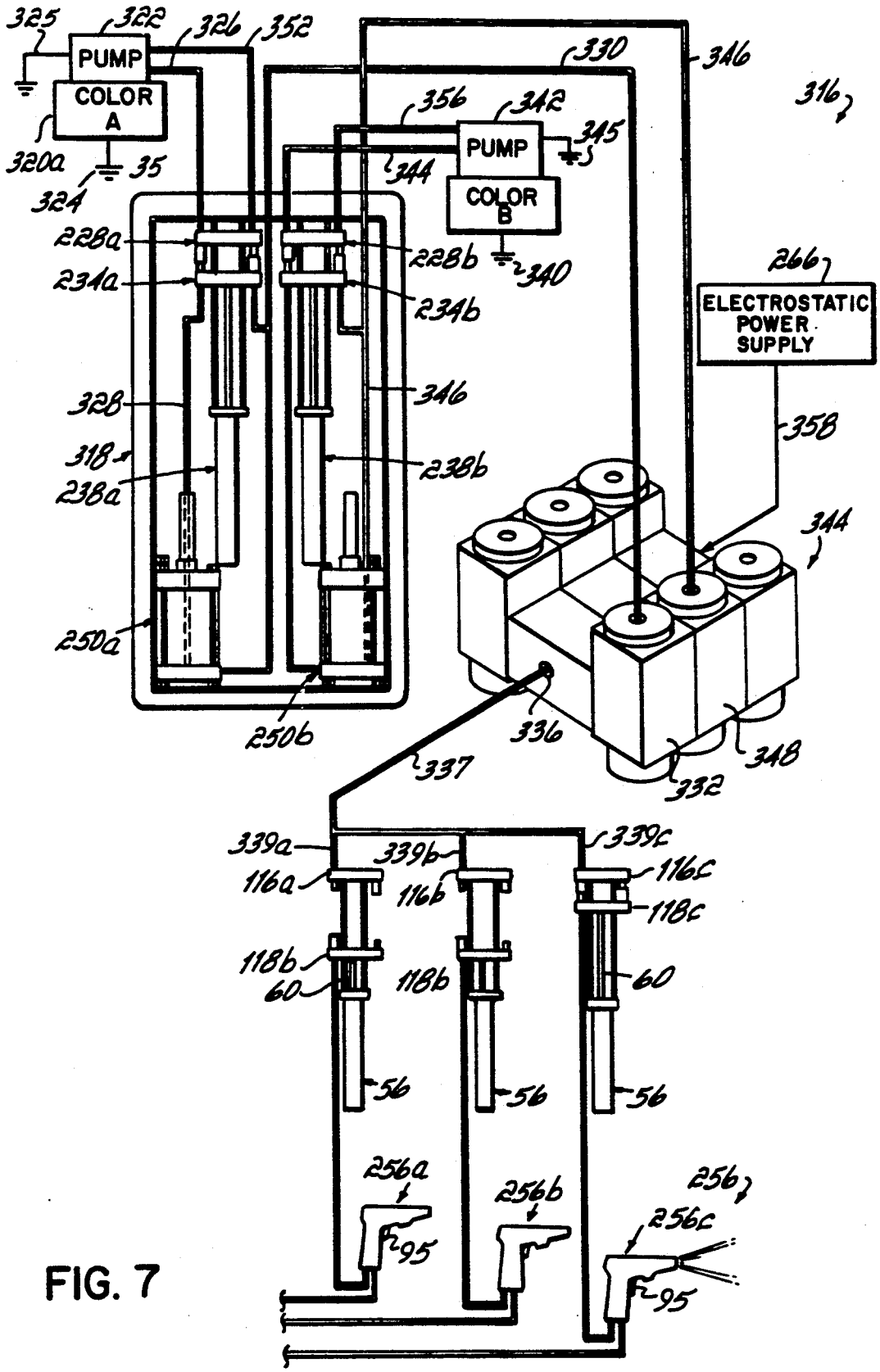
FIG. 7 is a schematic view similar to FIG. 5 in which the spray guns are electrically isolated from the high voltage electrostatic power supply.

Embodiment of FIG. 7: Multiple Paint Sources and Electrically Isolated Spray Guns The embodiment of apparatus 316 depicted in FIGS. 5 and 6 is primarily intended for use with automatically actuated spray guns 256 wherein no manual intervention is required or contemplated As depicted in FIG. 5, a single supply line 337 extends from the paint supply manifold 336 of color changer 334 to the branch lines 339*a, b, c* connected to spray guns 256*a, b, c*, respectively. As a result, all of the spray guns 256 are continuously charged by the charged paint regardless of whether or not they are operating. Only when the electrostatics of the entire system is shut down, i.e., by deactivating power supply 266, will the electrostatics to each of the spray guns 256 be deactivated.

In order to adapt the apparatus 316 for use with manual spray guns, to comply with the requirements of the National Fire Protection Code, the individual shuttle system of the apparatus 10 depicted in FIGS. 1 and 2, is employed and interposed between the color changer 334 and the spray guns 256. As shown in FIG. 7, a separate discharge station 116*a, b* and *c*, and an associated discharge shuttle 118*a, b* and *c*, is provided for each of the spray guns 256*a, b* and *c* employed in this embodiment. The operation of the discharge station 116*a, b, c* and discharge shuttle 118*a, b, c*, and the control system associated therewith, is identical to that described in detail above in connection with FIGS. 1 and 2 and is not repeated herein. As described above, such system provides a voltage block between the electrostatically charged coating material and each of the spray guns 256*a, b* and *c* so that such spray guns 256*a, b* and *c* are deactivated when they are not in use. The structure and operation of the apparatus of this embodiment is otherwise identical to apparatus 316, with the electrostatic power supply 266 being connected either to color changer 334 as shown in FIG. 7 or to one of the piston pumps 250 within housing 318 as shown in FIGS. 5 and 6.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the apparatus 316 depicted in FIGS. 5–7 has been schematically illustrated as including six individual sources of paint having different colors for use with a color changer of the type disclosed in U.S. Pat. No. 4,830,055. It should be understood that essentially any number of separate coating sources could be employed, depending upon the capacity of a particular color changer and/or the requirements of a given application. Additionally, the number of spray guns employed in the apparatus 10, 12 and 316 depicted herein are shown for purposes of illustration and essentially any other numbers of guns could be used.

Therefore, it is intended that the invention not be limited to the particular embodiment disclosed as the best mode contemplated for carrying out this invention, but that the invention will include all embodiments falling within the scope of the appended claims.

We claim:

1. Apparatus for dispensing electrically conductive coating material, comprising:

at least one source of electrically conductive coating material;

a number of coating dispensers each operative to dispense coating material when opened and to terminate the flow of coating material when closed;

first transfer means for receiving coating material from said at least one source;

second transfer means for receiving coating material from said first transfer means, and for transmitting the coating material to said coating dispensers;

electrostatic charging means for applying an electrostatic charge to the coating material which is supplied to said coating dispensers from said second transfer means;

first voltage block means for electrically isolating said first transfer means from said electrostatic charging means while said first transfer means receives coating material from said at least one source, and for electrically isolating said second transfer means from said at least one source of coating material while said second transfer means receives coating material from said first transfer means;

a second voltage block means connected between each of said coating dispensers and said electrostatic charging means for supplying charged coating material to a respective coating dispenser when said coating dispenser is opened to dispense coating material, and for electrically isolating said respective coating dispenser from said charged coating material when said coating dispenser is closed to terminate the flow of coating material.

2. The apparatus of claim 1 wherein said first transfer means comprises a first pump having a reservoir which communicates with said at least one source of coating material.

3. The apparatus of claim 2 in which said first voltage block means includes:

a filling station;

a first shuttle movable with respect to said filling station between a transfer position wherein said first shuttle is connected to said filling station and a neutral position wherein said first shuttle is spaced from said filling station;

one of said filling station and said first shuttle being connected to said at least one source of coating material, and the other of said filling station and said first shuttle being connected to said reservoir of said first pump.

4. The apparatus of claim 3 wherein said second transfer means comprises a second pump having a reservoir which communicates with said coating dispensers.

5. The apparatus of claim 4 in which said first voltage block means includes:

a transfer station;

a second shuttle movable with respect to said transfer station between a transfer position wherein said second shuttle is connected to said transfer station and a neutral position wherein said second shuttle is spaced from said transfer station;

one of said transfer station and said second shuttle being connected to said reservoir of said first pump, and the other of said transfer station and said second shuttle being connected to said reservoir of said second pump.

6. The apparatus of claim 4 in which each of said second voltage block means comprises:

a discharge station;

a third shuttle movable with respect to said discharge station between a discharge position wherein said third shuttle is connected to said discharge station and a neutral position wherein said third shuttle is spaced from said discharge station;

one of said transfer station and said third shuttle communicating with said reservoir of said second pump, and the other of said transfer station and said third shuttle being connected to one of said coating dispensers.

7. The apparatus of claim 6 in which each of said coating dispensers is a manually operated spray gun having a trigger which opens and closes said spray gun, said apparatus further including control means communicating with said trigger for causing said third shuttle to move to said discharge position in response to squeezing of said trigger to close said spray gun, and for causing said third shuttle to move to said neutral position in response to release of said trigger to open said spray gun.

8. The apparatus of claim 7 in which said control means communicates with said electrostatic charging means and is operative to activate said electrostatic charging means in response to squeezing of said trigger to open said spray gun, and to deactivate said electrostatic charging means in response to release of said trigger to close said spray gun.

9. The apparatus of claim 8 in which said control means includes delay means for delaying said deactivation of said electrostatic charging means for a predetermined period of time after release of said trigger.

10. The apparatus of claim 4 in which said charging means comprises an electrostatic power supply which is connected by an electrostatic cable to said second pump for producing charged coating material within said reservoir of said second pump which is discharged therefrom to said coating dispensers.

11. Apparatus for dispensing electrically conductive coating material, comprising:

a number of sources of electrically conductive coating material of different color;

at least one coating dispenser operative to dispense coating material when closed and to terminate the flow of coating material when opened;

first transfer means for receiving coating material from said at least one source;

color changer means interposed between said sources of coating material and said first transfer means for selectively supplying coating materials of different color to said first transfer means;

second transfer means for receiving coating material from said first transfer means, and for transmitting the coating material to said at least one coating dispenser;

electrostatic charging means for applying an electrostatic charge to the coating material which is supplied to said at least one coating dispenser from said second transfer means;

first voltage block means for electrically isolating said first transfer means from said electrostatic charging means while said first transfer means receives coating material from one of said sources of coating material, and for electrically isolating said second transfer means from said at least one source of coating while said second transfer means receives coating material from said first transfer means;

a second voltage block means connected between said at least one coating dispenser and said electrostatic charging means for supplying charged coating material to said at least one coating dispenser when said at least one coating dispenser is opened to dispense coating material, and for electrically isolating said at least one coating dispenser from said charged coating material, when said at least one coating dispenser is closed to terminate the flow of coating material.

12. The apparatus of claim 11 wherein said first transfer means comprises a first pump having a reservoir which communicates with said color changer means.

13. The apparatus of claim 12 in which said first voltage block means includes:

a filling station;

a first shuttle movable with respect to said filling station between a transfer position wherein said first shuttle is connected to said filling station and a neutral position wherein said first shuttle is spaced from said filling station;

one of said filling station and said first shuttle being connected to said color changer means, and the other of said filling station and said first shuttle being connected to said reservoir of said first pump.

14. The apparatus of claim 13 wherein said second transfer means comprises a second pump having a reservoir which communicates with said at least one coating dispenser.

15. The apparatus of claim 14 in which said first voltage block means includes:

a transfer station;

a second shuttle movable with respect to said transfer station between a transfer position wherein said second shuttle is connected to said transfer station and a neutral position wherein said second shuttle is spaced from said transfer station;

one of said transfer station and said second shuttle being connected to said reservoir of said first pump, and the other of said transfer station and said second shuttle being connected to said reservoir of said second pump.

16. The apparatus of claim 14 in which said second voltage block means comprises:

a discharge station;

a third shuttle movable with respect to said discharge station between a discharge position wherein said third shuttle is connected to said discharge station and a neutral position wherein said third shuttle is spaced from said discharge station;

one of said transfer station and said third shuttle communicating with said reservoir of said second pump, and the other of said transfer station and said third shuttle being connected to said at least one coating dispenser.

17. The apparatus of claim 16 in which said at least one coating dispenser is a manually operated spray gun having a trigger which opens and closes said spray gun, said apparatus further including control means communicating with said trigger for causing said third shuttle to move to said discharge position in response to squeezing of said trigger to close said spray gun, and for causing said third shuttle to move to said neutral position in response to release of said trigger to open said spray gun.

18. The apparatus of claim 17 in which said control means communicates with said electrostatic charging means and is operative to activate said electrostatic charging means in response to squeezing of said trigger to open said spray gun, and to deactivate said electrostatic charging means in response to release of said trigger to close said spray gun.

19. The apparatus of claim 18 in which said control means includes delay means for delaying said deactivation of said electrostatic charging means for a predetermined period of time after release of said trigger.

20. The apparatus of claim 14 in which said charging means comprises an electrostatic power supply which is connected by an electrostatic cable to said second pump for producing charged coating material within said reservoir of said second pump which is discharged therefrom to said at least one coating dispenser.

* * * * *